US007377056B2

(12) United States Patent
Snow et al.

(10) Patent No.: US 7,377,056 B2
(45) Date of Patent: May 27, 2008

(54) SHOE CONSTRUCTION

(75) Inventors: Rebecca E. Snow, Foxboro, MA (US); Guilherme F. Roch, Franklin, MA (US); John Deem, Sharon, MA (US); Joanne M. Holmes, Manomet, MA (US); Kelly M. Myatt, Medford, MA (US)

(73) Assignee: The Rockport Company, LLC, Canton, MA (US)

( * ) Notice: Subject to any disclaimer, the term of this patent is extended or adjusted under 35 U.S.C. 154(b) by 301 days.

(21) Appl. No.: 11/182,898

(22) Filed: Jul. 18, 2005

(65) Prior Publication Data

US 2007/0011918 A1 Jan. 18, 2007

(51) Int. Cl.
*A43B 13/28* (2006.01)

(52) U.S. Cl. ..... 36/24.5; 36/30 R

(58) Field of Classification Search ..... 36/24.5, 36/30 R, 28, 76 C, 35 R
See application file for complete search history.

(56) References Cited

U.S. PATENT DOCUMENTS 1,724,349 A 8/1929 Haag
2,083,659 A * 6/1937 Nutt ..... 36/169
2,164,754 A * 7/1939 Maccarone ..... 12/146 R
2,217,341 A * 10/1940 Kamborian et al. ..... 36/24.5
2,228,149 A * 1/1941 Maccarone ..... 36/24.5
2,263,187 A * 11/1941 Parkhurst ..... 36/24.5
2,742,718 A * 4/1956 Benjamin ..... 36/24.5
4,400,893 A * 8/1983 Musci ..... 36/24.5
4,835,884 A * 6/1989 Bianchini et al. ..... 36/24.5
6,101,743 A * 8/2000 Brown ..... 36/102
6,519,874 B1 * 2/2003 Dean ..... 36/30 R

FOREIGN PATENT DOCUMENTS

GB 917582 2/1963
GB 1093363 11/1967

* cited by examiner

*Primary Examiner*—Marie Patterson
(74) *Attorney, Agent, or Firm*—Sterne, Kessler, Goldstein & Fox, P.L.L.C.

(57) ABSTRACT

A shoe with increased flexibility in a forefoot portion that includes an upper, an upper lining, an outsole, a footbed and a flexible insole. The flexible insole is located in the forefoot portion of the upper and is stitched directly to the upper lining along a perimeter of the flexible insole. The footbed includes a heel pad that is located in the heel portion of the shoe.

20 Claims, 4 Drawing Sheets

SHOE CONSTRUCTION

BACKGROUND OF THE INVENTION

1. Field of the Invention

The field of this invention generally relates to shoes, and more particularly to a shoe construction having increased flexibility.

2. Background of the Invention

The ideal shoe design attempts to incorporate the following essential features: comfort, lightweight, stability, support, flexibility, cushioning and shock absorption. Lightweight is an essential feature since it facilitates movement and minimizes fatigue of the wearer. Stability and support are necessary to provide proper foot support and to prevent injuries to the wearer. Flexibility allows the foot of the wearer to easily bend and move, thereby increasing comfort and reducing fatigue. Shock absorption and cushioning not only enhance comfort, but protect the human skeletal system from the adverse effects of the repeated impact forces encountered in walking, especially in hard heels. Fashion and style also influence the design of a shoe.

Prior attempts have been made to incorporate all of the features described above in shoe design. However, the attempts have generally been unable to provide the desired flexibility in the forefoot region while incorporating the other features.

The problems enumerated above are present in all shoes but are particularly acute in high heel shoes and even more acute in women's dress high heel shoes wherein the shoe construction is further limited by size and space constraints dictated by fashion. The need therefore exists for a shoe structure which effectively provides shock absorption, cushions the foot of the wearer, provides support and stability to the heel and midfoot portions of the foot and adequately accommodates the flexing of the forefoot of the wearer, while still satisfying the demands for comfort, fashion and style. Furthermore, the structure needs to lend itself to modern manufacturing methods.

One attempt to provide shock absorption in heeled shoes is found, for example in U.S. Pat. No. 1,724,349. This design provides a recess in the heel of the shoe for receiving a heel pad. However, such a construction fails to provide a strong lightweight structure for providing support to the arch and midfoot portion of the foot.

Many shoes utilize shanks and other supports for the midfoot portion of the shoe which are constructed of metal and plastic. However, none of the supports offer lightweight construction in combination with high strength. Furthermore, a smooth transition from the midfoot portion to the forefoot portion of the shoe is generally not provided, thereby decreasing comfort and stability.

Furthermore, many shoes that provide support in the midfoot portion of the shoe often provide only limited flexibility in the forefoot portion. For example, such designs often utilize a support that extends to the forefoot portion of the shoe or multiple layers in the forefoot portion that are coupled with adhesives, as shown in GB 1,093,363 and GB 917,582.

Accordingly, shoes especially high heel shoes, are deficient in meeting optimum or even acceptable levels of weight, stability, support, shock absorption, cushioning, flexibility and comfort. The present invention has satisfied these needs by providing a unique shoe structure having a lightweight, strong and stable support structure which incorporates a heel pad offering excellent shock absorption and having a smooth transition from the midfoot area to the forefoot area for a comfortable fashionable high heel shoe.

SUMMARY OF THE INVENTION

In one embodiment, a shoe includes an upper, an upper lining, a shank member, a footbed, a flexible insole and a flexible outsole. The upper lining is located on an inner surface of a forefoot portion of the upper. The flexible insole is coupled directly to the upper lining along a perimeter of the insole. The shank member includes a heel portion and a cushion basket and the footbed is located over the heel portion of the shank member. The footbed includes a heel pad disposed in the basket. The outsole is coupled to a bottom surface of the flexible insole.

In another embodiment, a shoe includes an upper, an upper lining, a shank member, a footbed, a flexible insole, a flexible outsole and a heel. The upper lining is located on an inner surface of a forefoot portion of the upper. The shank member has a heel portion and a cushion basket and a footbed is located over the heel portion. The footbed includes a heel pad located in the cushion basket. The flexible insole is located in the forefoot portion of the upper and is stitched to the upper lining along the perimeter of the flexible insole. A flexible outsole is coupled to a bottom surface of the flexible insole. The heel includes a cavity and the cushion basket is located in the cavity and the heel is coupled to the heel portion of the shank member.

In another embodiment, a shoe includes an upper, an upper lining, an outsole, a footbed and a flexible insole. The upper lining is located on an inner surface of a forefoot portion of the upper. The outsole has a flexible forefoot portion and a heel portion that includes a cavity. The outsole is coupled to the upper. The footbed includes a heel pad that is located in the cavity. The flexible insole is located in the forefoot portion of the upper and is stitched directly to the upper lining along a perimeter of the flexible insole.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

BRIEF DESCRIPTION OF THE DRAWINGS/FIGURES

Features, aspects and advantages of the present invention will become better understood with reference to the following description, appended claims, and accompanying drawings, which are not to scale.

DETAILED DESCRIPTION OF THE INVENTION

The present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
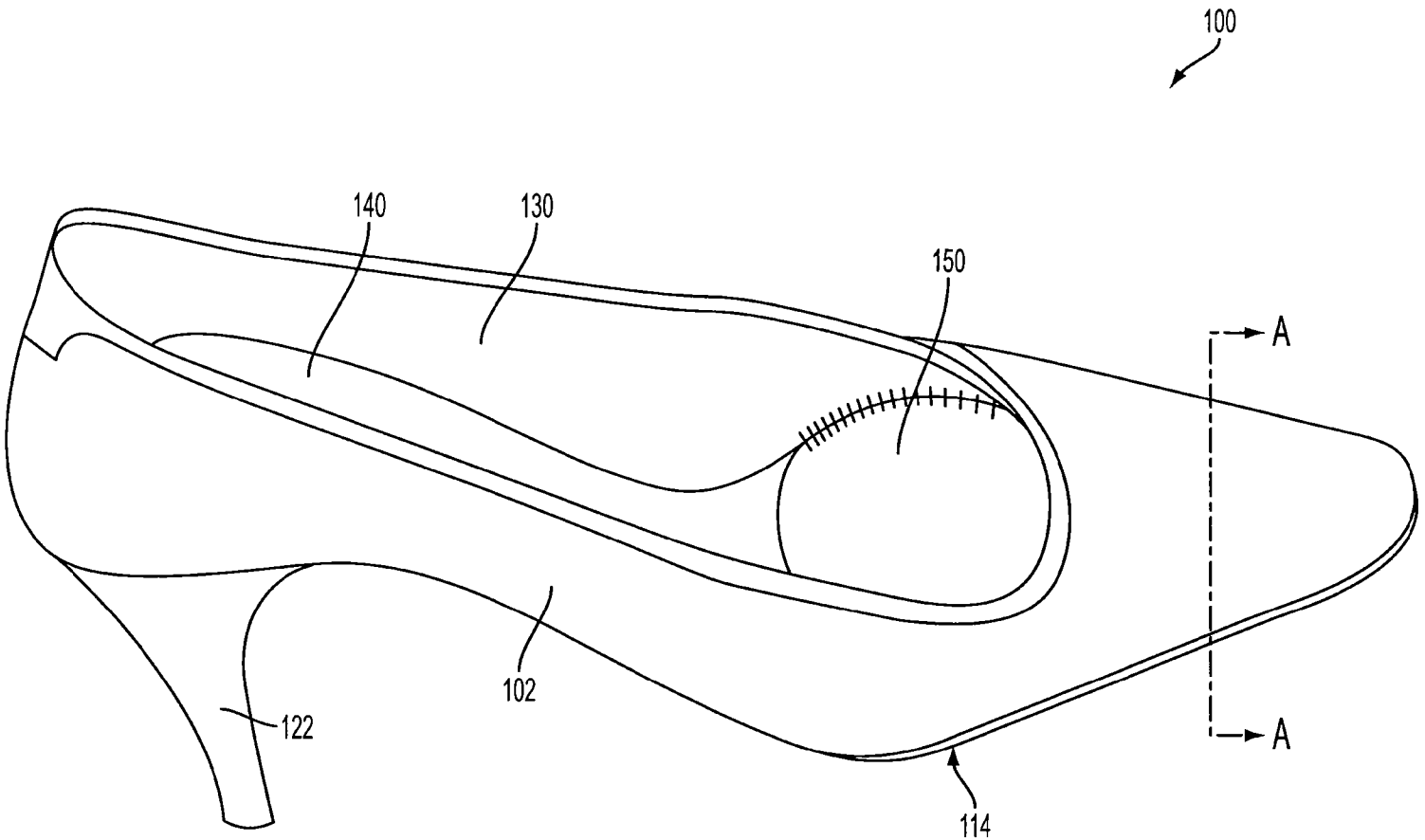
FIG. 1 is an elevational view of a shoe having the construction of the present invention.
Figure 2:
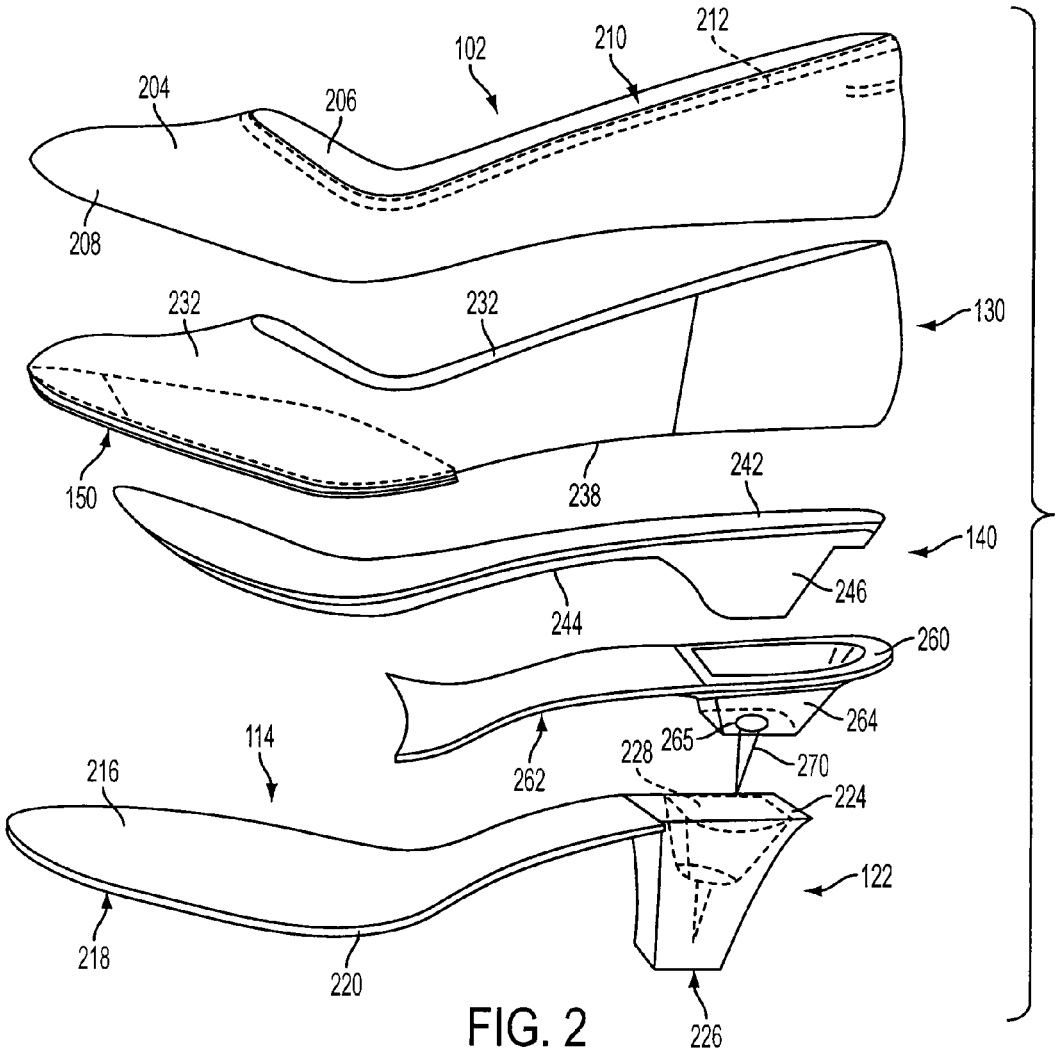
FIG. 2 is an exploded view of the shoe of FIG. 1.

A shoe 100 incorporating the construction of the present invention is illustrated in FIGS. 1 and 2. Shoe 100 generally includes an upper 102 an outsole 114, a heel 122, an insole 150, a shank member 258, an upper lining 130 and a footbed 140.

Upper 102 generally forms the body of shoe 100. Upper 102 includes an outer surface 204 and an inner surface 206. Upper 102 is shaped so that it forms a foot receiving pocket when it is combined with outsole 114. A foot opening 210 allows a user to insert their foot into the foot receiving pocket. Upper 102 may be constructed in any manner or of any material, e.g., leather, that is known in the art. Uppers are generally well known and will not be described in further detail herein.

Outsole 114 provides the ground contacting surface of shoe 100. In the present invention outsole 114 is flexible. Such flexible outsoles are also generally well known. Outsole 114 may be constructed in any manner or of any material that is known in the art. For example, the outsole may be constructed of rubber, leather or polyurethane.

Upper lining 130 is secured to inner surface 206 of upper 102 and generally matches the contour of inner surface 206. Upper lining 130 provides a comfortable surface for contacting a user's foot and may be constructed of fabric, leather or synthetic leather material. Upper lining 130 and upper 102 are secured to each other along an edge of foot opening 210 (at 212). In addition, in a midfoot portion and a heel portion of shoe 100, a lower perimeter 238 of upper lining 130 is secured to a lower perimeter 208 of upper 102 and both lower perimeters 238, 208 are further secured to top surfaces 216 and 224 of outsole 114 and heel 122, respectively. In a forefoot portion of shoe 100, lower perimeter 238 of upper lining 130 and lower perimeter 208 of upper 102 are not attached.

Lower perimeter 208 of upper 102 and lower perimeter 238 of upper lining 130 are interposed between and coupled to top surfaces 216 and 224 of outsole 114 and heel 122, and a bottom surface 262 of shank member 258. In addition, a portion of bottom surface 262 of shank member 258 is coupled to top surface 216 of outsole 114. Insole 150 is secured to upper lining 130 in the forefoot portion of shoe 100, as described in greater detail below, and footbed 140 is located on a top surface 260 of shank member 258 in the midfoot portion and the heel portion of shoe 100.

The forward edge of shank member 258 extends toward what is known in the art as the "flexline." The flexline corresponds to a theoretical line extending between the first and fifth metatarsal heads of a user's foot. This line is generally located where the majority of bending occurs during walking. To avoid interfering with the normal motion of the foot and to obtain maximum flexibility, shank member 258 is tapered toward the forward edge and does not extend past the flexline. It should be appreciated that shank member 258 may be omitted in shoe designs that require less structure such as flat shoes or shoes having low heels.

The stiffness of shank member 258 results in the midfoot and the heel portions of shoe 100 being stiff to match the biomechanics of those portions of a user's foot. The forefoot portion of shoe 100 is constructed to be flexible to match the biomechanics of the forefoot portion of a user's foot.

Figure 4:
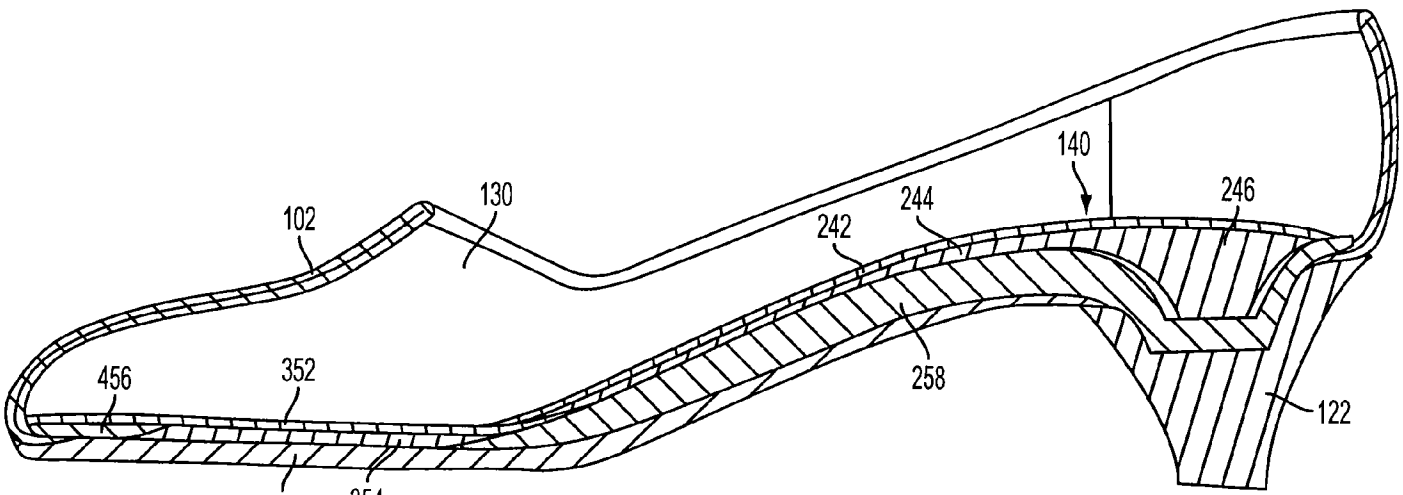
FIG. 4 is a cross-sectional view of the shoe of FIG. 1 taken longitudinally along the length of the shoe.
Figure 5:
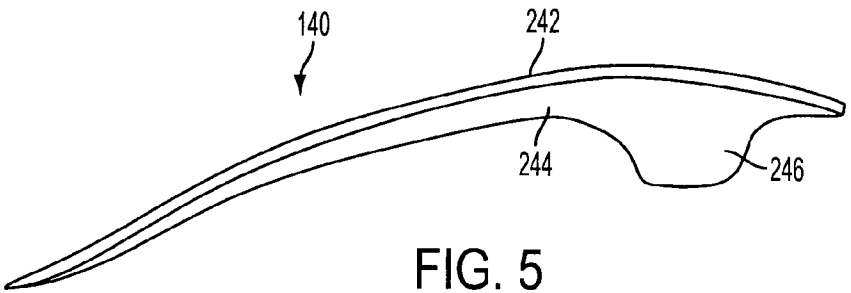
FIG. 5 is a side view of a footbed included in the shoe of FIG. 1.
Figure 3:
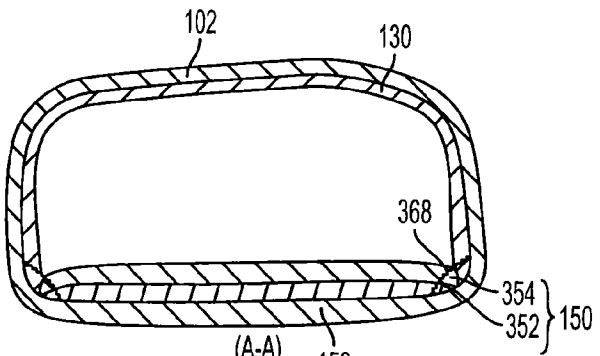
FIG. 3 is a cross-sectional view of a forefoot portion of the shoe of FIG. 1 taken along line A-A.

Lower perimeter 238 of upper lining 130 and lower perimeter 208 of upper 102 are not attached in the forefoot portion of shoe 100. However, lower perimeter 238 of upper lining 130 is attached to flexible insole 150. As shown in FIGS. 3 and 4, insole 150 includes a foot contacting layer 352 (i.e., a sock liner layer), a cushion layer 354 and a toe lasting board 456. Insole 150 is located directly on top surface 216 of outsole 114 without any additional component therebetween. It should also be appreciated that toe lasting board 456 may be replaced by a Strobel material, a portion of foot contacting 352 and/or cushion layer 354 may extend to the toe or the toe lasting board may be omitted. Further, it should be appreciated that foot contacting layer 352 may be considered part of the lining of the upper or lining of the footbed. Such a construction reduces the thickness of the forefoot portion of shoe 100 resulting in greater flexibility and cushioning.

Insole 150 is secured to the forefoot portion of lower perimeter 238 of upper lining 130 by stitching 368 along a portion of the outer edge of insole 150. However, it should be appreciated that the insole may be secured to the upper lining by any other method known in the art such as, for example, gluing or cementing. The forefoot portion of lower perimeter 208 of upper 102 is interposed between insole 150 and top surface 216 of outsole 114. Lower perimeter 208 is secured to insole 150 and top surface 216 of outsole 114 in a manner that does not significantly increase the stiffness of the forefoot portion of shoe 100. Toe lasting board 456 is located in a tip portion of insole 150 where flexibility is not required. Toe lasting board 456 is included so that the shape of the toe of shoe 100 does not significantly change after shoe 100 is worn. Insole 150 may also extend into the midfoot portion of shoe 100 and may be constructed from multiple components. The sections that do not require flexibility, for example sections located in the midfoot portion of shoe 100 on shank 258, may be constructed from any material including a stiff lasting material. Furthermore, the layers of such an insole may be configured such that a layer is located on top surface 260 of shank member 258 while another layer is located on bottom surface 262 of shank member 258.

Insole 150 is sized to fit within the forefoot portion of shoe 100 and may extend into the midfoot portion of shank member 258 as described above. Foot contacting layer 352 is constructed from a thin, flexible leather that is non-abrasive. Foot contacting layer 352 may alternatively be fabric or synthetic leather such as polyurethane (PU) coated fabric or split leather. Cushioning layer 354 is constructed from a thin flexible material such as PU, ethylene vinyl acetate (EVA) or latex rubber. Cushioning layer 354 may be molded with foot contacting layer 352 or separately molded and bonded to foot contacting layer 352. If cushioning layer 354 is bonded to foot contacting layer 352, any bonding method known in the art may be employed that does not significantly increase the stiffness of insole 150. Toe lasting board 456 may be constructed of any lasting board material that is known in the art.

Shank member 258 forms the structural frame upon which the midfoot and heel portions of shoe 100 are constructed. Shank member 258 provides a stable and comfortable platform for the user's foot and also provides a structure for securing heel 122, outsole 114 and upper 102. However, shank member 258 provides minimal shock absorption. Shank member 258 may be constructed of plastic, metal, a fiber composite material or any other material known in the art. For example, the shank member may be constructed from glass filled reinforced nylon, steel or thermoplastic polyurethane.

In order to provide shock absorption, and to protect the foot of the wearer from the impact forces of walking, particularly at heel strike, shank member 258 has an integral basket 264 for receiving a heel pad 246. Basket 264 is shaped so as to generally conform to the contour and size of heel pad 246. A hole 265 is provided in the bottom of basket 264 through which a fastener 270 may be inserted to secure shank member 258 to heel 122. Fastener 270 may be a screw, rivet, nail, other fastener, or a plurality thereof. Adhesives or any other type of fastener may also be employed. Heel 122 is provided with a cavity 228 for receiving basket 264. Cavity 228 generally conforms in size and shape to the external surface of basket 264 so as to provide a large amount of abutting surface area. It should be appreciated that basket 264 may be separate from shank member 258 or basket 264 may be omitted entirely.

Footbed 140 is located on top surface 260 of shank member 258. Heel pad 246 is integrally formed as part of footbed 140. Footbed 140 generally includes a top foot contacting layer 242 (i.e., a sock liner layer) and a bottom cushioning layer 244. Similar to foot contacting layer 352 of insole 150, top layer 242 of footbed 140 is constructed from a thin, flexible leather that is non-abrasive. Bottom layer 244 of footbed 140 is constructed from a cushioning material such as PU, EVA or latex rubber.

Heel pad 246 is shaped substantially frustroconical and oriented with its base at the top. Basket 264 has a complementary shape to receive heel pad 246. Heel pad 246 provides a high degree of shock absorption in the central portion with a progressively increasing degree of shock absorption from the periphery of heel pad 246 towards the central portion of heel pad 246.

Alternatively, heel pad 246 may be constructed separately from footbed 140 and attached thereto or heel pad 246 may be inserted into basket 264 as a separate component. Many different materials can be utilized for foot bed 140 and heel pad 246 such as PU, EVA, latex or any other suitable elastomer known in the art. It should also be appreciated that heel pad 246 may be constructed in a variety of shapes. For example, heel pad may be shaped as a pyramid or a cylinder having any cross-sectional shape such as a circle, an ellipse, a polygon or combinations thereof.

Figure 6:
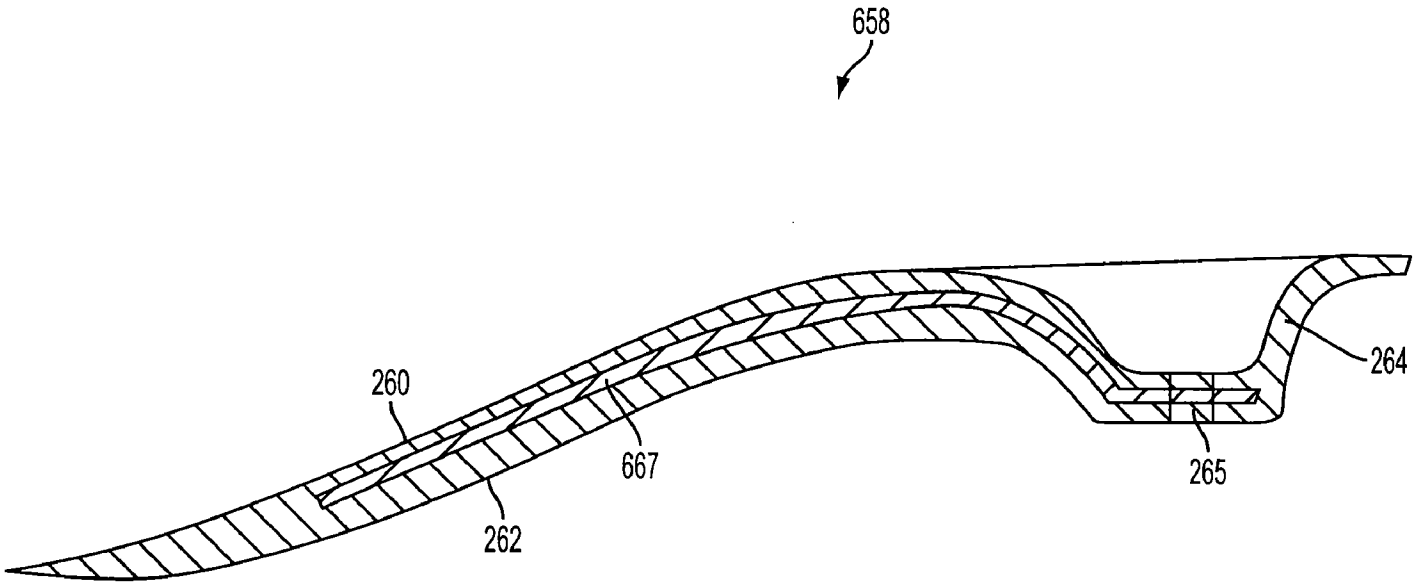
FIG. 6 is a cross-sectional view of another embodiment of a shank member that may be included in the shoe of FIG. 1.

As shown in FIG. 6, shank member 658 may also have a shank stiffener 667 for increasing the rigidity of shank member 658. Shank member 658 is molded about shank stiffener 667, as shown. Molding shank stiffener 667 within shank member 658 simplifies construction of shank member 658 because shank stiffener 667 may be placed in a mold for forming shank member 658 so that shank member 658 is formed with shank stiffener 667 in situ. Such a process provides for a secure and permanent attachment of shank stiffener 667 to shank member 658. Alternatively, shank stiffener 667 can be secured in some other fashion. For example, a recess may be provided in shank member 658 with shank stiffener 667 inserted therein. Shank stiffener 667 may be constructed of plastic, metal, a fiber composite material or any other material known in the art.

As a result of this construction, the heel and midfoot portions of the shoe provide support and cushioning while the forefoot portion provides improved flexibility. First, the shank member provides support and stability in the heel and midfoot portions of the shoe. Next, the heel pad combined with the footbed provide increased cushioning. Finally, the construction of the forefoot portion assures that there is a minimal number of layers and/or a minimal amount of adhesive in that portion thereby improving flexibility.

While the shoe construction according to the invention has been described with regard to a woman's high heel shoe, numerous modifications and variations of the present invention are possible which could be applied to general footwear or to other specialized forms of footwear. It should be appreciated in particular that such a construction may be incorporated into shoes with or without heels designed for men or women.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A shoe comprising:

an upper having an upper lining disposed on an inner surface of a forefoot portion of said upper, wherein said upper lining is not attached to said forefoot portion of said upper;

a shank member having a heel portion and a cushion basket;

a footbed disposed over said heel portion of said shank member, said footbed including a heel pad disposed in said basket;

a flexible insole disposed in said forefoot portion of said upper, wherein said flexible insole is coupled directly to said upper lining along a perimeter of said flexible insole; and a flexible outsole coupled to a bottom surface of said flexible insole.

2. The shoe of claim 1, wherein said upper is not coupled directly to said flexible insole.

3. The shoe of claim 1, wherein said flexible insole is stitched directly to said upper lining.

4. The shoe of claim 1, wherein said flexible insole includes a foot contacting layer and a cushioning layer.

5. The shoe of claim 1, wherein said footbed includes a foot contacting layer and a cushioning layer.

6. The shoe of claim 1, further comprising a stiff lasting material disposed in a tip portion of said upper.

7. The shoe of claim 1, further comprising a heel coupled to a bottom surface of said heel portion of said shank member, wherein said heel includes a cavity configured to receive said cushion basket.

8. The shoe of claim 7, wherein said flexible outsole is coupled to said heel.

9. The shoe of claim 7, further comprising a fastener fastening said cushion basket to the heel.

10. The shoe of claim 1, further comprising a shank stiffener embedded in said shank member.

11. The shoe of claim 1, wherein the footbed includes a flexible forefoot portion.

12. The shoe structure of claim 11, wherein said footbed is removable.

13. A shoe comprising:

an upper having an upper lining disposed on an inner surface of a forefoot portion of said upper, wherein said upper lining is not attached to said forefoot portion of said upper;

a shank member having a heel portion and a cushion basket;

a footbed disposed over said heel portion of said shank member, said footbed including a heel pad disposed in said cushion basket;

a flexible insole disposed in said forefoot portion of said upper, wherein said flexible insole is stitched to said upper lining along the perimeter of said flexible insole;

a flexible outsole coupled to a bottom surface of said flexible insole; and a heel that includes a cavity, wherein said cushion basket is disposed in said cavity and said heel is coupled to said heel portion of said shank member.

14. The shoe of claim 13, wherein said upper is not stitched directly to said flexible insole.

15. The shoe of claim 13, wherein said flexible insole includes a foot contacting layer and a cushioning layer.

16. The shoe of claim 13, further comprising a stiff lasting material disposed in a tip portion of said upper.

17. A shoe comprising:

an upper having an upper lining disposed on an inner surface of a forefoot portion of said upper, wherein said upper lining is not attached to said forefoot portion of said upper;

an outsole having a flexible forefoot portion and a heel portion that includes a cavity, the outsole being coupled to said upper;

a footbed including a heel pad that is disposed in said cavity; and a flexible insole disposed in said forefoot portion of said upper, wherein said flexible insole is stitched directly to said upper lining along a perimeter of said flexible insole.

18. The shoe of claim 17, wherein said upper is not stitched directly to said flexible insole.

19. The shoe of claim 17, further comprising a cushion basket, wherein said heel pad is disposed in said cushion basket such that both said heel pad and said cushion basket are disposed in said cavity.

20. The shoe of claim 19, further comprising a shank member coupled to said cushion basket.

* * * * *